United States Patent [19]

Ashworth

[11] Patent Number: 4,687,073

[45] Date of Patent: Aug. 18, 1987

[54] HYDRAULICALLY ELEVATABLE ACCESS EQUIPMENT

[75] Inventor: Denis H. Ashworth, Womborne, England

[73] Assignee: Simon Engineering Dudley Limited, West Midlands, England

[21] Appl. No.: 634,587

[22] Filed: Jul. 26, 1984

[30] Foreign Application Priority Data

Jul. 30, 1983 [GB] United Kingdom ..... 8320618
Apr. 18, 1984 [GB] United Kingdom ..... 8410160

[51] Int. Cl.[4] ..... B66F 11/04

[52] U.S. Cl. ..... 182/2; 182/63; 182/19; 182/62.5

[58] Field of Search ..... 182/2, 63, 207, 208, 182/65, 18, 19, 62.5; 212/264, 267–269, 149, 188; 52/114, 115, 118, 119

[56] References Cited

U.S. PATENT DOCUMENTS

| | | | |
|---|---|---|---|
| 1,531,982 | 3/1925 | Sago | 182/65 |
| 3,305,220 | 2/1967 | Nevulis | 182/2 |
| 3,461,989 | 8/1969 | Prescott | 182/2 |
| 3,524,521 | 8/1970 | Boomgaarder | 182/2 |
| 3,732,743 | 5/1973 | Ballard | 182/2 |
| 3,842,933 | 10/1974 | Clark | 182/2 |
| 3,891,056 | 6/1975 | Ashworth | 182/2 |
| 3,958,377 | 5/1976 | Milner | 52/118 |
| 4,081,055 | 3/1978 | Johnson | 182/19 |
| 4,088,200 | 5/1978 | Cowley | 182/2 |
| 4,314,622 | 2/1982 | Lindquist | 182/2 |
| 4,411,368 | 10/1983 | Manjot | 212/149 |

*Primary Examiner*—Reinaldo P. Machado
*Assistant Examiner*—Alvin Chin-Shue
*Attorney, Agent, or Firm*—Nies, Webner, Kurz & Bergert

[57] ABSTRACT

Access equipment including a vehicle (10) on which stands a mast (14) movable between horizontal and vertical positions and mounted for rotation about an axis (13). The mast is telescopically extendible and carries a pivoted boom (17) which is also telescopically extendible and carries a further boom (19) with a working platform (20) thereon. Booms (17, 19) can operate only when the mast (14) is vertical. A cable system maintains platform (20) level for all positions of booms (17, 19) and at least two sets of conduits extend from the vehicle (10) to the platform (20). A take-up system for maintaining the conduits taut is located in casing (54) attached to mast (14) and includes sets of rollers (61 to 69) for supporting the conduits around curved paths and preventing them from becoming entangled.

15 Claims, 6 Drawing Figures

HYDRAULICALLY ELEVATABLE ACCESS EQUIPMENT

This invention concerns access equipment of the kind in which a boom assembly comprising two or more articulated booms is pivotally attached about a horizontal axis to a supporting structure, usually mounted on a vehicle, and powered means are provided for elevating the booms relative to each other and to the supporting structure.

In equipment of this kind it is common for a first or lowermost boom to be pivotally attached at one end to the supporting structure with a further boom attached at the free or distal end of the first boom about a horizontal axis so that the booms can be extended from a substantially horizontal and parallel stowed condition to an elevated condition in which the booms are generally vertically aligned. A working platform is usually attached to the outermost end of the second boom to enable personnel to gain access to elevated positions above the ground or vehicle upon which the assembly is mounted or to escape from such positions.

Such equipment may be required to provide a maximum working height of 60 meters or more, but environmental constraints place a limit on the overall length of the equipment in the stowed condition, particularly when it is mounted on a vehicle and thus transported by road. A 12-meter travelling length is normally acceptable, but this requires that the boom system must be telescopically extendible and conventionally presents many difficulties with regard to stability and accommodation of service conduits which must extend throughout the maximum working height of the boom system.

It is an object of the present invention to provide an improved form of access equipment of the kind generally described above, and wherein the aforementioned difficulties are substantially overcome.

According to the present invention there is provided, access equipment including a boom mounted on a supporting structure and consisting of a first section and at least one further section telescopically extendible relative thereto; at least two superimposed sets of conduits laid side-by-side in each set, anchored at one end with respect to the first section and extendible with said extendible section, and a take-up system for maintaining the conduits taut for all positions of said extendible section, there being, at a location, means causing said conduits to follow a curved path which describes an angle in excess of 90°, said means comprising two arrays of arcuately displaced rollers, which divide said path into inner and outer curved supporting surfaces respectively, one for each set of conduits.

An embodiment of the invention will now be described, by way of example only, with reference to the accompanying drawings in which.

Figure 5:
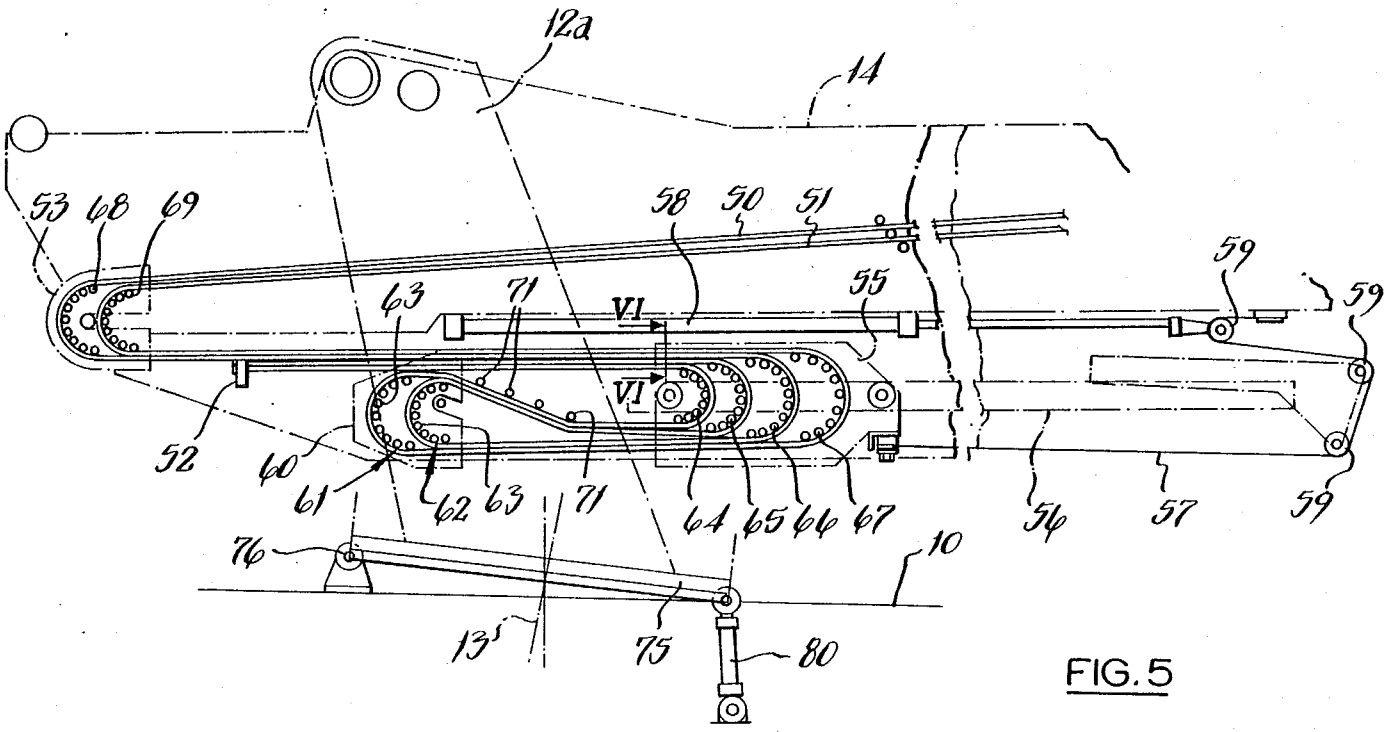
FIG. 5 is a schematic illustration of a system within the apparatus for controlling the movements of several sets of conduits required for operational purposes.
Figure 6:
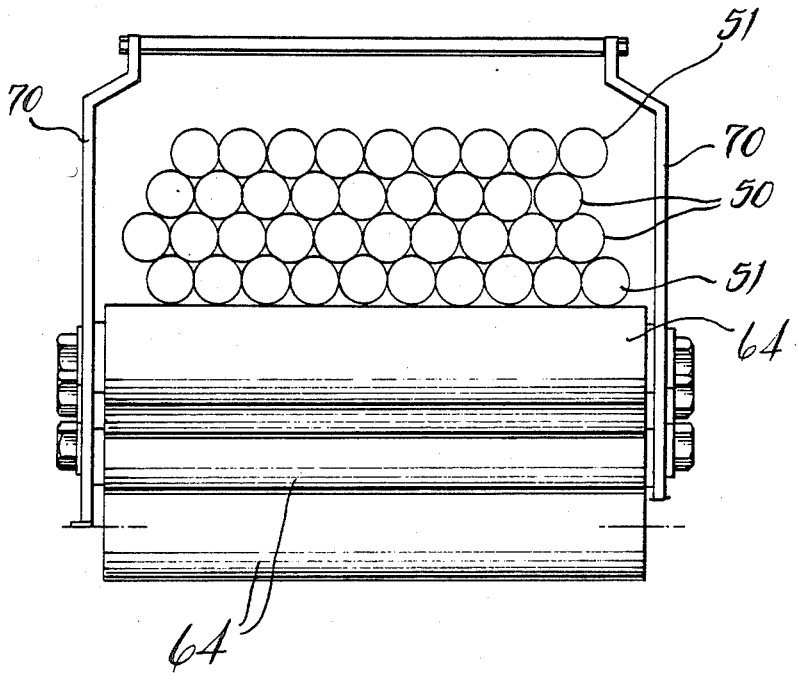

and FIG. 6 is a section taken on line VI—VI of FIG. 5.

Figure 1:
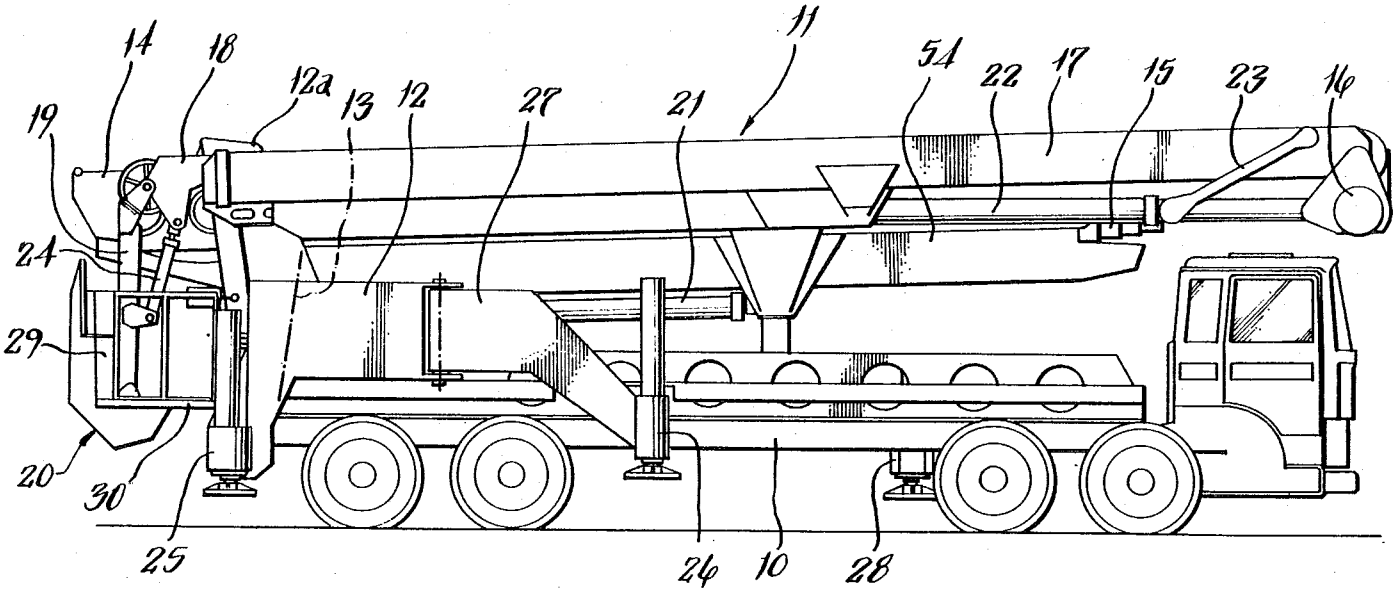
FIG. 1 is a side elevation of the apparatus to be described.

FIG. 1 illustrates a vehicle having a chassis 10 on which is mounted a mast and boom assembly generally indicated at 11. This consists of a supporting structure 12 having an upper portion 12*a* mounted for continuous rotation through 360° about a vertical axis 13 on a turntable (not visible in FIG. 1) mounted on the chassis 10. The axis 13 can be adjusted to assume a vertical operating position irrespective of the attitude (within limits) of the chassis 10, i.e. if the vehicle is standing on a slope, the rotational axis of the turntable can be rendered vertical as will be described. Pivotally attached about a horizontal axis to the supporting structure 12 is a first boom or mast 14 which is extendible telescopically by four nested internal members illustrated at 15.

Figure 2:
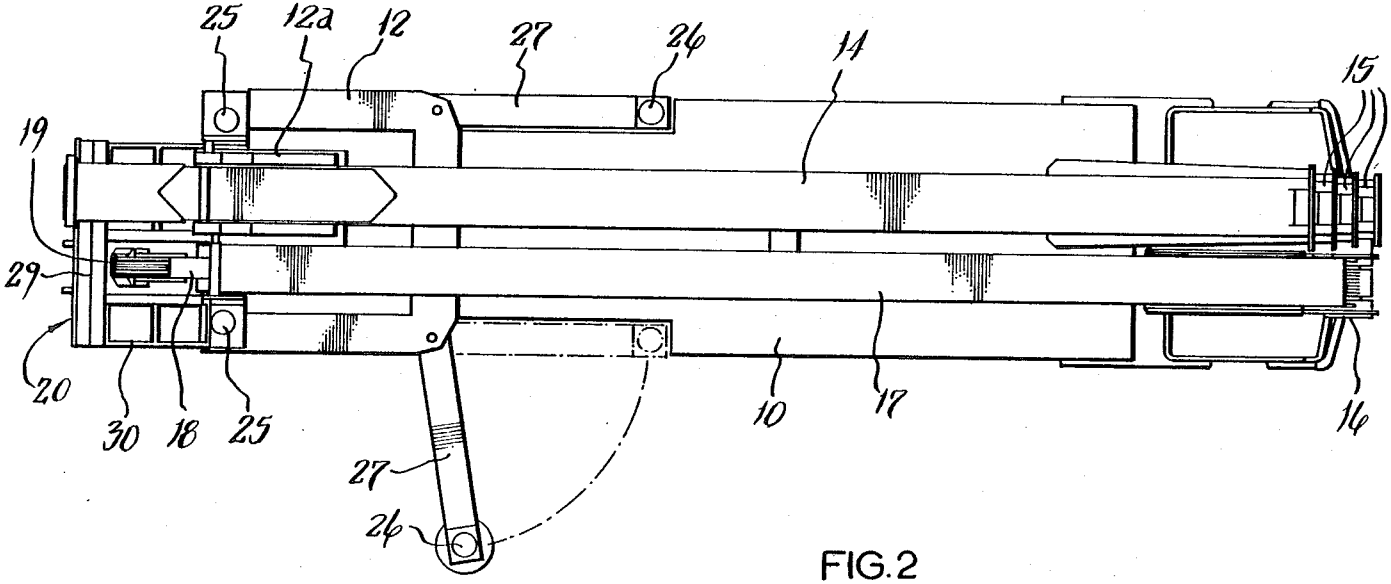
FIG. 2 is a plan thereof.

Pivotally attached to the distal end of mast 14, about a horizontal axis 16 is a boom 17, and this also includes a telescoping inner section 18 to which is pivotally attached a relatively short third boom 19 carrying at its distal end a working platform 20. As can be seen in FIG. 2, boom 17 lies alongside mast 14 in the stowed position.

A first hydraulic cylinder 21 is extendible to raise the mast 14 from the generally horizontal stowed position illustrated in FIG. 1 to a generally vertical operating position. A further hydraulic cylinder (not shown) is positioned within mast 14 for extending the telescopic sections 15.

A second hydraulic cylinder 22 and associated linkage 23, is extendible to swing boom 17 outwardly from its position in which it is parallel to mast 14 to a fully extended position in which it is generally aligned therewith. A third hydraulic cylinder 24 is extendible to cause pivotal movement of the third boom 19 from a stowed position generally at right angles to boom 17, to a fully elevated position in which it is generally aligned therewith. A first pair of ground engaging jacks 25 adjacent the rear of the vehicle chassis is extendible downwardly from supporting structure 12 to which the jacks are attached, and a second pair of ground engaging jacks 26 is extendible downwardly from a pair of outriggers 27 pivotally attached to supporting structure 12 thus to extend generally transverse to the longitudinal centre line of the vehicle and to provide increased stability when the boom assembly 11 is elevated. A further single jack 28 is mounted centrally towards the front of the chassis 10.

A cable levelling system is provided for maintaining the working platform 20 level for all positions of boom 11 relative to mast 14 when the mast is fully upright. Platform 20 comprises a base 29 which is disposed vertically when the boom assembly is in the stowed condition illustrated in FIGS. 1 and 2, and an upstanding framework of side members 30.

Figure 3:
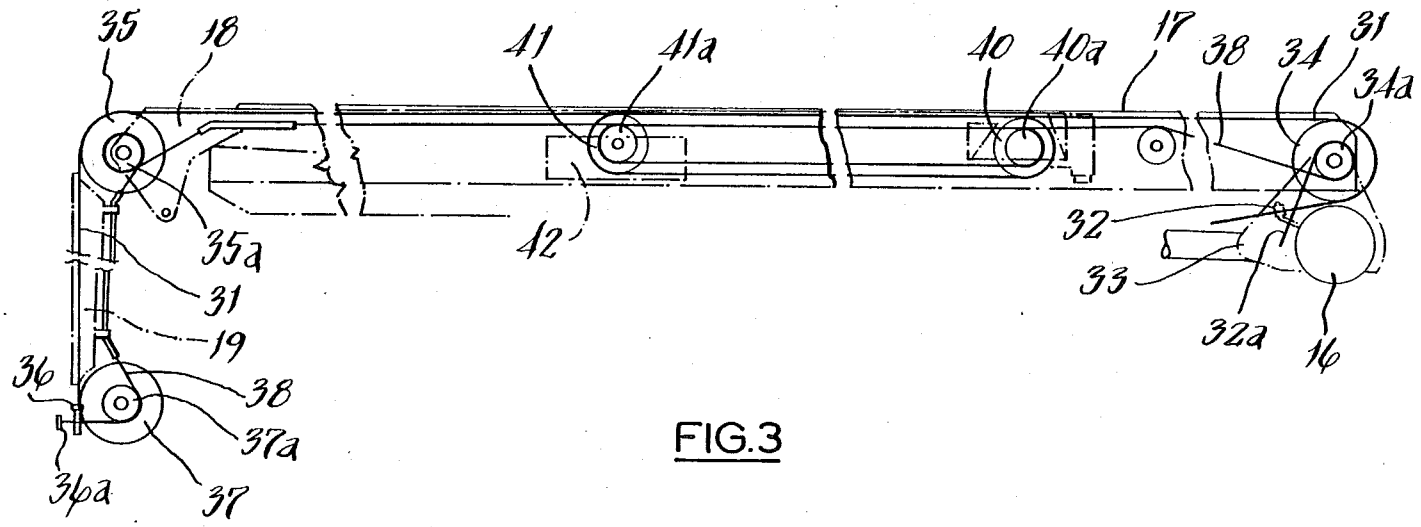
FIG. 3 is a detailed view of a platform levelling system included in the apparatus.

Referring now to FIG. 3, the levelling system comprises a first cable 31 anchored at 32 to a fixed member 33 adjacent the pivotal axis 16 of boom 17. The cable extends around a first pulley 34 at the root end of the boom 17, a second pulley 35 at the distal end thereof, and is anchored at 36 adjacent a third pulley 37 on the working platform 20. A second cable 38 passes in the reverse direction around smaller diameter pulleys 34*a*, 35*a* and 37. Cable 38 is similarly anchored at points 32*a* and 36*a* adjacent points 32 and 36.

Internal pulleys 40, 40*a* and 41, 41*a* are mounted within boom 17, and pulleys 41 and 41*a* are mounted on a sliding carriage 42 therein thus to accommodate extension and retraction of the internal boom member 18 relative to boom 17. This part of the apparatus is well known and has been used in many telescopically extending systems, and forms no part of the present invention. Therefore, further detailed description of the means for causing telescopic extension of mast 14 and boom 17, is not required for an understanding of the present invention.

Similarly a system of telescoping and articulating ladders (not shown) can be provided along the mast and booms, to provide an escape facility.

Although the drive means for causing telescopic extension and retraction of mast 14 and boom 11 is well known, the equipment includes a novel arrangement whereby a considerable number of conduits such as hydraulic control hoses, air hoses for breathing apparatus when the equipment is to be used for fire fighting purposes, water hoses for similar purposes, and electrical control means, can be accommodated within the mast and boom, and at least some of them can extend throughout the working height of the equipment with all sections fully extended. For practical purposes it may be required to run as many as twenty conduits from the base of the equipment adjacent the chassis 10 to a height of some 60 meters when the equipment is fully elevated.

Such an arrangement will now be described with reference to FIGS. 5 and 6 in which there are illustrated two superimposed sets 50 and 51 of conduits which are brought down through the boom 17 and mast 14 to a fixed location 52 adjacent the base of the mast. Housed within a removable casing 54 (see FIG. 1) below mast 14 is a take-up system for maintaining the conduits taut for all configurations of the mast and boom assembly. Since the shortest possible travelling length for the vehicle is to be achieved, i.e. in the region of 12 meters, and since there are five telescoping sections of the mast and two such sections of the boom, it is necessary that the take-up system for taking up the slack in the conduits as the boom and mast retract, is accommodated within the shortest length of the mast. Thus it will be seen that there is provided a carriage 55 slidable along a track 56 within housing 54, and attached by a cable 57 to an hydraulic cylinder 58 via pulleys 59. The parts are illustrated in FIG. 5 in their positions for full extension of the mast and boom, although for convenience of illustration, the mast is shown in the horizontal position in FIG. 5. Mounted in a fixed position near the base of the mast 14 is a pair of spaced brackets 60 carrying between them two arrays 61 and 62 of arcuately displaced freely rotatable rollers 63 which, as will be described, provide a pair of semi-circular supporting surfaces, one for each of the sets of conduits 50 and 51. The surfaces enable the conduits to follow a curved path which describes an angle of 180° or more. On the carriage 55 which is also constructed from a pair of spaced plates there are four such arrays of rollers providing four separate curved surfaces for supporting the conduits. A further pair of curved sets of rollers 68 and 69 are provided between fixed plates 53 at the lowermost or innermost end of mast 14.

Conduit sets 50 and 51 extend from their anchor position within housing 54 to pass around roller sets 64 and 65 on carriage 55 then return under guide roller 71 to pass around roller sets 61 and 62 and thereafter pass around roller sets 66 and 67 on carriage 55 before extending out of housing 54 to pass around roller sets 68 and 69 at the base of the mast from which they proceed onwardly through the interior of the mast. This arrangement whereby the conduits pass twice around roller sets on the carriage with an intermediate passage around roller sets 61 and 62 provides the facility whereby for a certain distance moved by the carriage, the outermost telescoping extension of the mast may move together with conduits 50 and 51 by a distance equal to four times that travelled by the carriage. The carriage moves to the left in FIG. 5 by extension of the mast, with the conduits themselves pulling the carriage, whilst during retraction of the mast, cylinder 58 is withdrawn to move the carriage to the right in FIG. 5, thus taking-up the surplus lengths of conduit.

The staggered sets of rollers, in pairs 61 and 62, 64 and 65, 66 and 67, and 68 and 69 are required in order to prevent the conduit sets 50 and 51 from becoming entangled, as might be the case should each pair be replaced by a common pulley around which the two sets of conduits pass in superimposed relationship.

FIG. 6 shows the rollers on carriage 55 mounted between a pair of side plates 70 and four superimposed layers constituted by conduits 50 and 51, the lower two moving in the opposite direction to the upper two when the carriage is in motion. On a straight section such as this, the conduits are free to pass one another and there is no tendency for them to become entangled. Furthermore, the two sets may pass in superimposed relationship over the shallow slope of guide rollers 71 close to roller sets 61 and 62.

FIG. 5 further illustrates schematically a short hydraulic cylinder 80 which, as has been described earlier, is used to tilt the rotational axis 13 of turntable 75 which is pivotally mounted at 76 on vehicle chassis 10, according to the attitude of the ground along the longitudinal axis of the vehicle. In practice, in the travelling position, the axis 13 is tilted forwards by approximately $7\frac{1}{2}°$, and the cylinder 80 can be extended to rotate the axis rearwardly through approximately 15°.

In operation, for practical purposes, the apparatus is designed to permit the mast to be erected into a vertical position on any combination of cambers (lateral slope) and longitudinal slopes of up to $7\frac{1}{2}°$ in either direction.

The apparatus is set up for operation by firstly extending jacks 25 into contact with the ground in order to raise the rear wheels of the vehicle clear of the ground and to level the chassis 10 laterally. Jack 28 is then extended to raise the front end of the vehicle clear of the ground. Outriggers 27 are then extended to positions generally at rights angles to the longitudinal centre line of the vehicle, as illustrated at one side in FIG. 2. Associated jacks 26 are extended into contact with the ground to provide sufficient stability for elevation of the boom assembly.

Elevation is commenced by extending cylinder 24 towards alignment of the third boom 19 with second boom 17, and, due to the levelling cables 31 and 38, this causes the base 29 of platform 20 still to remain vertical.

Extension of cylinder 21 to its maximum stroke causes mast 14 to be elevated to a position generally parallel to axis 13. If the mast is not vertical in this position, i.e. if the vehicle is positioned on sloping ground, then the turntable is tilted by cylinder 80 relative to chassis 10 until the mast assumes a truly vertical position. Once the mast is vertical, and during further operation of the equipment, it is locked in this position in the usual way by an interlock system controlled by a two-axis level indicator.

Figure 4:
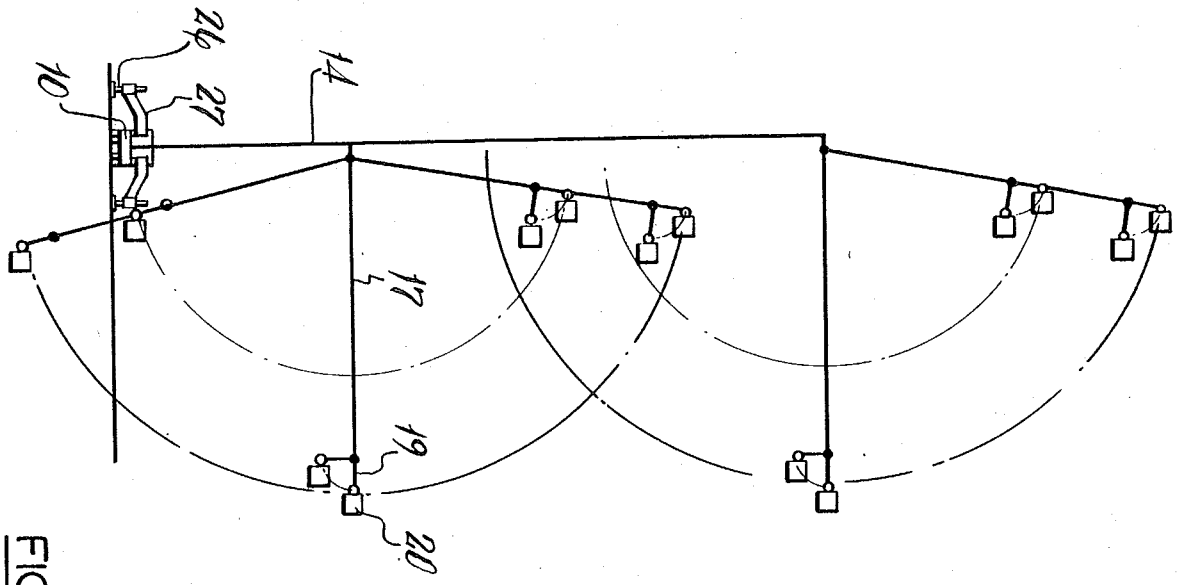
FIG. 4 is a schematic illustration of the scope of operation of the apparatus.

Not until the mast 14 is elevated and locked, which renders the base 29 of platform 20 horizontal, can booms 17 and 19 be manipulated by operation of their powered cylinders 22 and 24, nor mast 14 and boom 17 be telescopically extended as required, to place the platform 20 in any position within the scope of the equipment as illustrated in FIG. 4.

Since the mast cannot be articulated from its vertical operating position during operation, the maximum transverse reach of the boom assembly is constant throughout the vertical telescopic stroke of the mast. An additional advantage in placing the mast 14 in a static vertical position for operation is that the power required to rotate the turntable is minimal since its axis is always vertical during rotation, and thus there is no tendency for it to rotate "down hill" should there be a failure of its drive means.

In practice, the equipment can be designed to have a working height of 60 meters whilst the entire travelling length of the vehicle when the boom assembly is in the stowed condition as illustrated in FIG. 1 can be as little as 12 meters. The stowed height of the equipment including the vehicle is maintained at only 3.66 meters since the boom 17 lies alongside the mast 14 in the stowed position.

Again, since the mast 14 is vertical for all operating positions of booms 17 and 19, the levelling cables need extend from the platform 20 only as far as the root end of boom 17. This presents substantial savings in manufacturing cost when compared with a system in which the levelling cables must be accommodated wihin the telescoping sections of the lowermost boom or mast.

What is claimed is:

1. Access equipment including a boom mounted on a supporting structure and consisting of a first section and at least one further section telescopically extendible relative thereto; at least two sets of side-by-side conduits with one set superimposed above the other, the conduits being anchored at one end with respect to the first section and extendible with said extendible section, a take-up system for maintaining the conduits taut for all positions of said extendible section, there being, at a location, pully means around which said conduits pass and comprising at least two groups of rollers, each group having parallel roller axes displaced around an arcuate path so as to present a curved supporting surface for an associated set of conduits.

2. Access equipment according to claim 1, wherein said boom comprises a mast pivotally mounted at one end on a supporting structure to be movable between a generally horizontal stowed position thereon and a vertical operating position, the mast comprising a multiplicity of telescopically extendible sections, there being a boom pivotally attached end-to-end to the mast thus to be movable between a first position in which it is parallel to and alongside the mast, and the second position in which it is generally aligned therewith, said conduits extending from the supporting structure throughout the maximum length of the mast and boom when extended.

3. Access equipment according to claim 1, wherein the rollers of each said group are mounted to be freely rotatable on and between a pair of spaced side plates.

4. Access equipment according to claim 1, wherein at least one group of said rollers defines a generally semicircular supporting surface for said conduits.

5. Access equipment according to claim 1, wherein said take-up system is housed within a casing removably attached to said boom.

6. Access equipment according to claim 1, wherein said take-up system comprises a carriage movable upon retraction of said extendible section to take-up surplus lengths of said conduits; a first pair of groups of rollers at a fixed location with respect to said boom; and two further pairs of said groups of rollers mounted on said carriage, said conduits passing around a first pair of groups of rollers on said carriage before passing to said pair of groups of rollers at said fixed location and returning to the second pair of groups of rollers on said carriage, thus to provide a 4:1 ratio of movement such that the carriage moves by one quarter of any distance moved by said extendible section.

7. Access equipment according to claim 6, wherein drive means are provided to move said carriage thus to take-up surplus lengths of conduit as said extendible section retracts, whilst upon extension of said extendible section, said carriage is drawn by the conduits.

8. Access equipment comprising a supporting structure, a turntable for rotation thereon about a vertical axis through 360°, a telescopically elevatable mast pivotally mounted about a horizontal axis at the turntable to be movable between a generally horizontal collapsed condition and a vertical operating condition, a boom telescopically extendible and pivotally attached end-to-end to the mast thus to be movable between a first condition in which it is collapsed and parallel to and horizontally arranged alongside the mast, and a second condition in which it is extended and substantially aligned therewith, means to permit pivotal movement of the boom relative to the mast only while the mast is vertical, and a plurality of control conduits extending from the supporting structure continuously throughout the maximum extended length of the mast and boom, the ratio of the overall working height of the mast and boom when both are fully extended, to their overall length when both are fully collapsed, being approximately 5:1.

9. Access equipment according to claim 8, wherein said mast comprises a first section attached to said supporting structure and four further sections telescopically extendible relative thereto.

10. Access equipment according to claim 16, wherein said supporting structure is mounted on the chassis of a vehicle, said turntable is mounted thereon for rotation through 360°, and said mast is mounted on said turntable, a number of ground engaging jacks being extendible downwardly into contact with the ground from said supporting structure in order to render the rotation axis of the turntable vertical when said vehicle is upon uneven ground.

11. Access equipment according to claim 8, including means for tilting said turntable thus to adjust the rotational axis thereof to be vertical.

12. Access equipment according to claim 11, wherein the turntable may be tilted through an angle of 15°.

13. Access equipment according to claim 8, wherein said boom comprises a first section pivotally attached to said mast and one further section telescopically extendible relative thereto, there being a second boom pivotally attached end-to-end to said boom and carrying a working platform.

14. Access equipment according to claim 13, including a levelling cable for said working platform, anchored thereto and to the end of said boom which is connected to said mast, said cable maintaining said working platform level for all positions of said boom relative to said mast when the mast is vertical.

15. Access equipment according to claim 13, wherein said second boom is disposed vertically adjacent said supporting structure when said mast is in said horizontal stowed position, and the working platform attached to said second boom is disposed with its base generally vertical, the platform being moved to an upright position by movement of said mast to its vertical operating position.

* * * * *